US010494862B2

(12) United States Patent
Zhang

(10) Patent No.: US 10,494,862 B2
(45) Date of Patent: Dec. 3, 2019

(54) DRIVING ASSEMBLY AND WINDOW BLIND

(71) Applicant: Huicai Zhang, Qingxin (CN)

(72) Inventor: Huicai Zhang, Qingxin (CN)

( * ) Notice: Subject to any disclaimer, the term of this patent is extended or adjusted under 35 U.S.C. 154(b) by 237 days.

(21) Appl. No.: 15/662,688

(22) Filed: Jul. 28, 2017

(65) Prior Publication Data

US 2017/0321476 A1 Nov. 9, 2017

(30) Foreign Application Priority Data

Jul. 11, 2017 (CN) ..... 2017 1 0559172

(51) Int. Cl.

| | |
|---|---|
| ***E06B 9/32*** | (2006.01) |
| ***E06B 7/086*** | (2006.01) |
| ***E06B 9/262*** | (2006.01) |
| *E06B 9/28* | (2006.01) |

(52) U.S. Cl.

CPC ..... *E06B 9/32* (2013.01); *E06B 7/086* (2013.01); *E06B 9/262* (2013.01); *E06B 2009/2622* (2013.01); *E06B 2009/285* (2013.01)

(58) Field of Classification Search

CPC . E06B 9/32; E06B 9/303; E06B 9/322; E06B 9/262; E06B 7/086; E06B 2009/3222; E06B 2009/285; E06B 2009/2622; E06B 9/60; E06B 9/90; E06B 2009/3225; E06B 2009/2627

See application file for complete search history.

(56) References Cited

U.S. PATENT DOCUMENTS

| | | | | |
|---|---|---|---|---|
| 4,852,627 | A * | 8/1989 | Peterson | E06B 9/262 160/84.02 |
| 6,644,375 | B2 * | 11/2003 | Palmer | E06B 9/322 160/170 |
| 9,127,500 | B2 * | 9/2015 | Huang | E06B 9/322 |
| 9,482,049 | B2 * | 11/2016 | Chen | E06B 9/322 |
| 9,874,057 | B2 * | 1/2018 | Huang | E06B 9/322 |
| 9,957,750 | B2 * | 5/2018 | Lin | E06B 9/262 |
| 9,963,933 | B2 * | 5/2018 | Chen | E06B 9/322 |
| 9,976,345 | B2 * | 5/2018 | Chen | E06B 9/322 |
| 10,151,140 | B2 * | 12/2018 | Chen | E06B 9/322 |
| 10,221,619 | B2 * | 3/2019 | Chen | E06B 9/322 |
| 2002/0088562 | A1 * | 7/2002 | Palmer | E06B 9/322 160/170 |
| 2006/0278348 | A1 * | 12/2006 | Huang | E06B 9/322 160/170 |

(Continued)

*Primary Examiner* — Brent W Herring

(74) *Attorney, Agent, or Firm* — Shimokaji IP

(57) ABSTRACT

A driving assembly for window blinds includes a mounting plate, a winding roller and driving wheels that are engaged with one another, at least one first guiding roller, and at least one second guiding roller. An elastic element is elastically wound around the driving wheels, a pull rope has a starting end fixed to the winding roller and is divided into at least two sections, under a first status, the pull rope partially winds around the winding roller then winds around the second guiding roller and the first guiding roller in turns along outer edges of the second and the first guiding rollers; while under a second status, the pull rope disengages from the winding roller, the second guiding roller and the first guiding roller in turns. The driving assembly has simple structure and convenient assembly, and brings effortless and quick operation to pull or lift the window blind.

20 Claims, 8 Drawing Sheets

(56) References Cited

U.S. PATENT DOCUMENTS

| | | | | |
|---|---|---|---|---|
| 2013/0032300 | A1* | 2/2013 | Yu | E06B 9/322 160/84.02 |
| 2014/0083631 | A1* | 3/2014 | Huang | E06B 9/322 160/170 |
| 2014/0291431 | A1* | 10/2014 | Huang | E06B 9/322 242/372 |
| 2015/0136336 | A1* | 5/2015 | Huang | E06B 9/322 160/170 |
| 2015/0275572 | A1* | 10/2015 | Huang | E06B 9/322 160/173 R |
| 2015/0275573 | A1* | 10/2015 | Huang | E06B 9/322 160/192 |
| 2016/0230454 | A1* | 8/2016 | Chen | E06B 9/322 |
| 2016/0265272 | A1* | 9/2016 | Chen | E06B 9/322 |
| 2016/0290038 | A1* | 10/2016 | Hung | E06B 9/322 |
| 2016/0340975 | A1* | 11/2016 | Huang | E06B 9/322 |
| 2017/0204656 | A1* | 7/2017 | Chen | E06B 9/322 |
| 2017/0321477 | A1* | 11/2017 | Chen | E06B 9/322 |
| 2017/0356241 | A1* | 12/2017 | Lin | E06B 9/262 |
| 2017/0362887 | A1* | 12/2017 | Lin | E06B 9/303 |
| 2018/0163463 | A1* | 6/2018 | Lin | E06B 9/262 |
| 2019/0048655 | A1* | 2/2019 | Lin | E06B 9/305 |

* cited by examiner

DRIVING ASSEMBLY AND WINDOW BLIND

RELATED APPLICATIONS

This application claims the benefit of priority to Chinese Invention Application No. 201710559172.6, filed Jul. 11, 2017, which is hereby incorporated by reference in its entirety.

FIELD OF THE INVENTION

The present invention relates to window blinds, and more particularly to a driving assembly and a window blind including the same.

BACKGROUND OF THE INVENTION

In conventional window blinds, multiple slats are connected trapezoidal ropes that are extended between a top rail and a bottom rail, one or more pull ropes run through the slats and extend from the bottom rail to the top rail. The bottom rail will be raised towards the top rail under an upward force applied to the pull rope, in such a way, the slats will be retracted from bottom to top. Due to restrictions of the blinds system and driving manner, the pull rope is longer than the total length of the window blinds after the window blinds are retracted, which brings potential strangulation hazard to children.

Cord-free window blinds are developed to solve the above problems, which use a spring driver as a driving source connected to a winding reel or a winding roller, and a pull rope wound around the winding reel or winding roller. On operation, the spring driver supplies a lift force to counteract the resultant force of the gravity of the slats and the force applied by a hand, by the means of balance force of the friction, the gravity, the force provided by the spring driver and the force applied the hand, the window blind can be retracted or extended at a desired position. However, such a balance is difficult to achieve by the spring driver. When the window blind is pulled, the force supported by the spring driver is reduced as the slats are support by the trapezoidal ropes. Contrarily, when the window blind is withdrawn, the force supported by the spring driver is increased due to the loads of the bottom rail and the slats. Thus some problems will be generated if the lift force provided by the spring driver is constant. For example, since the force supported by the spring driver is reduced gradually when the window blind is pulled down, thus the pull force of the hand must be increased gradually and will reach to the maximum at the bottom, and once the hand is loosed, the window blind will be rebounded due to the inertia. For preventing such a rebound, a counterweight must be added at the bottom of the window blind such as the bottom rail. When a hand lifts the bottom rail to retract the blind, the force supported by the spring driver is increased gradually, the lift force of the hand must be increased accordingly and will reach to the maximum at the top. Under this situation, the window blind may not be maintained at the top position, but fall down slowly. For improving this problem, one or more driving element is added at the top rail to increase the friction to balance the force supported by the spring driver.

However, the above structures are complicated and the cost is increased. In the mass production, the frictions become indefinite due to assembling process and different using ways, thus the rebound force, the frictions and the gravity may still mismatch to bring the unbalanced force.

Thus, there is a need to provide an improved driving assembly and a window blind to overcome the drawbacks mentioned above.

SUMMARY OF THE INVENTION

One objective of the present invention is to provide a driving assembly for window blinds, which has simple structure and convenient assembly, and brings effortless and quick operation to pull or lift the window blind.

Another objective of the present invention is to provide a window blinds with a driving assembly, which has simple structure and convenient assembly, and brings effortless and quick operation to pull or lift the window blind.

To achieve the above objectives, the present invention provides a driving assembly adapted for window blinds, the driving assembly comprises a mounting plate, a winding roller and at least one pair of driving wheels that are engaged with one another and rotationally mounted on the mounting plate, at least one first guiding roller located at a side of the at least one pair of driving wheels, and at least one second guiding roller located at a side of the winding roller. An elastic element is elastically wound around the driving wheels to provide driving force for the winding roller, a pull rope has a starting end fixed to the winding roller and is divided into at least two pull rope sections at a predetermined position, and the pull rope sections are adapted for running through multiple slats of the window blinds and connected with a bottom rail of the window blinds, under a first status, the pull rope partially winds around the winding roller then winds around the second guiding roller and the first guiding roller in turns along outer edges of the second guiding roller and the first guiding roller; while under a second status, the pull rope disengages from the winding roller, the second guiding roller and the first guiding roller in turns.

As an embodiment, the driving wheels comprise a first driving wheel and a second driving wheel that are engaged with one another, and the second driving wheel is further engaged with the winding roller.

Preferably, the elastic element is elastically wound between the first driving wheel and a second driving wheel, one end of the elastic element is connected to the first driving wheel, and another end of the elastic element is connected to the second driving wheel.

Preferably, the second driving wheel comprises an engaging plate that is engaged with the first driving wheel and the winding roller, a spindle rotationally mounted on the mounting plate, and an elastic leaf wheel rotationally mounted on the spindle, the elastic element is received in the elastic leaf wheel, one end of the elastic element is connected to the first driving wheel, and another end of the elastic element is connected to the elastic leaf wheel.

Preferably, two pairs of driving wheels are included, each pair of driving wheels has two driving wheels engaged with one another, and one said elastic element is configured between the two driving wheels.

Preferably, the first driving wheel comprises an engaging plate that is engaged with the second driving wheel and a spindle rotationally mounted on the mounting plate.

Preferably, the first guiding roller and the second guiding roller are rotationally mounted on the mounting plate.

Preferably, a bearing is respectively provided on the first guiding roller and the second guiding roller.

Preferably, two first guiding rollers and two second guiding rollers are configured.

Preferably, a groove is formed on the first guiding roller and/or the second guiding roller for guiding the pull rope.

Preferably, two first guiding rollers and two second guiding rollers are configured, the pull rope has a single pull rope section located at a front end and dual pull rope sections at a back end, the single pull rope section is wound around the winding roller, and the dual pull rope sections come out of the winding roller are wound along outer edges of the second guiding rollers and outer edges of the first guiding rollers in turns for several circles, one of the dual pull rope sections will be come out of one of the first guiding rollers, and another of the dual pull rope sections will be come out of one of the second guiding roller.

The present invention further provides a window blind, which comprises a top rail, a bottom rail and multiple slats that are movable relative to the top rail, and a driving assembly mounted in the top rail to actuate the slats and the bottom rail, wherein the driving assembly is as mentioned above.

In comparison with the prior art, the driving assembly of the present invention includes the driving wheels and the winding roller that are engaged with one another, the pull rope is divided into two or more sections at the predetermined position, and the pull rope is partially wound on the winding roller and then wound on the second guiding roller and the first guiding roller in turns along their edges. Such a winding manner can achieve synchronous movements of two ends of the window blind, thereby preventing asynchronization to generate inclination of the window blind when extending or retracting the window blind. Furthermore, the structure is simple, and an effortless and quick operation to pull or lift the window blind is obtained. Additionally, the present invention has reduced cost and simple assembly to save time and manpower, the using life is extended, and the manufacturing method is easy, which is desired by the manufacturers.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1:
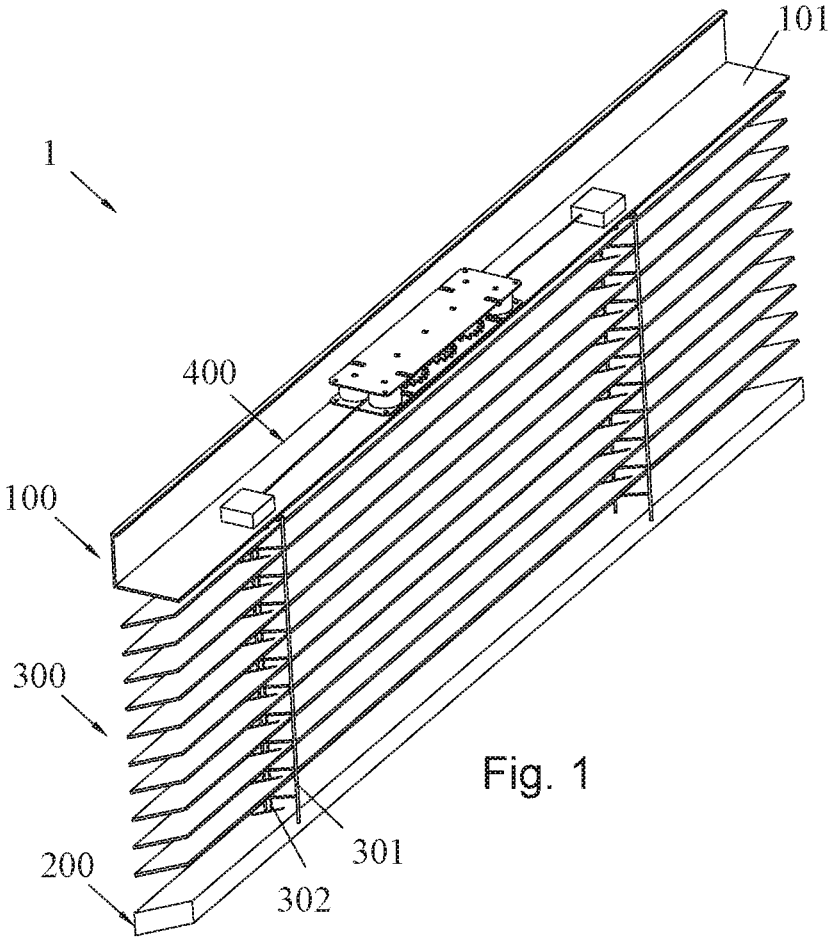
FIG. 1 is a partial perspective view of a window blind according to one embodiment of the present invention.

Various preferred embodiments of the invention will now be described with reference to the figures, wherein like reference numerals designate similar parts throughout the various views.

Referring to FIG. 1, a window blind 1 includes a top rail 100, a bottom rail 200 and multiple slats 300 connected between the top rail 100 and the bottom rail 200. The slats 300 will be extended if the bottom rail 200 is pulled down by a hand and will be folded if the bottom rail 200 is lifted up by a hand.

The slats 300 are connected and supported by a trapezoidal rope 301 extended between the top rail 100 and the bottom rail 200, and a pull rope 302 is extended from the bottom rail 200 to the top rail 100, runs through the slats 300 and winds around the driving assembly 400. As shown in FIG. 1, the driving assembly 400 is fixed to a U-shape rail 101 (as shown, partially) of the top rail 100, which is adapted for actuating the slats 300 and the bottom rail 100.

Figure 2:
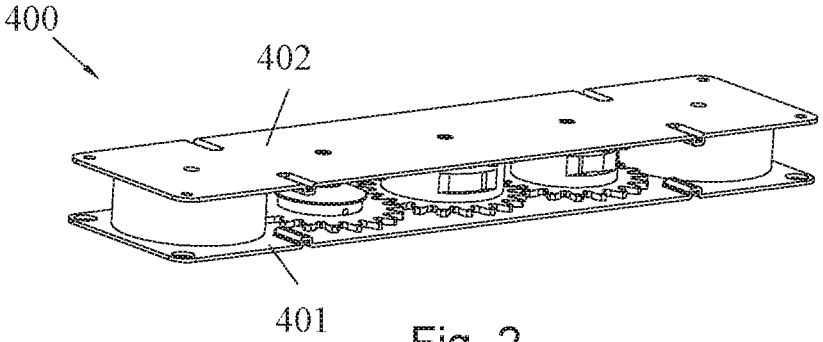
FIG. 2 is a perspective view of a driving assembly according to a first embodiment.
Figure 3:
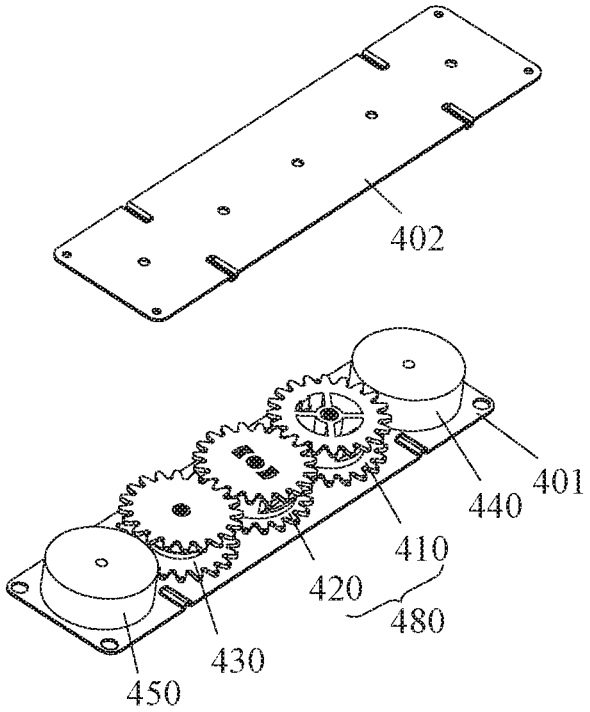
FIG. 3 is a partial exploded view of FIG. 2.
Figure 4:
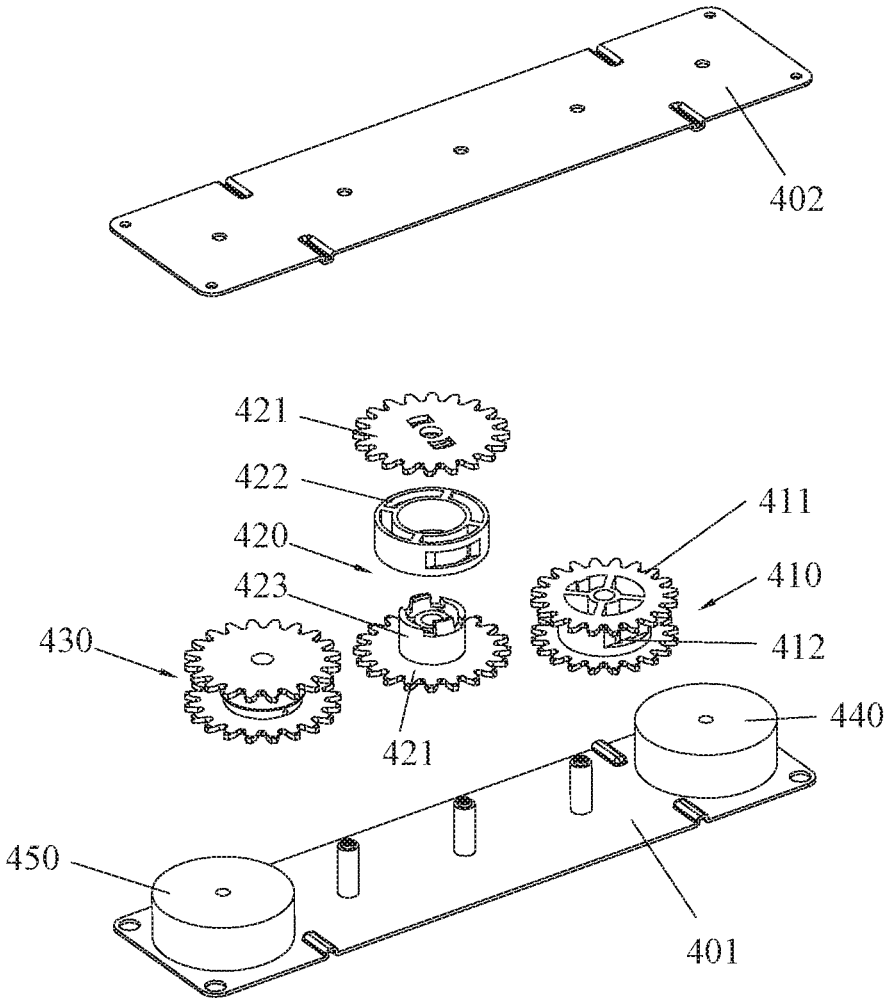
FIG. 4 is a further exploded view of FIG. 3.

Specifically, as shown in FIGS. 2-4, the driving assembly 400 includes a mounting plate 401, a winding roller 430 and at least one pair of driving wheels 480 that are engaged with one another and rotationally mounted on the mounting plate 401, at least one first guiding roller 440 located at a side of the at least one pair of driving wheels 480, and at least one second guiding roller 450 located at a side of the winding roller 430. Preferably, a cover plate 402 is included. In this embodiment, the driving wheels 480 includes a first driving wheel 410 and a second driving wheel 420 that are engaged with one another, specifically, the first driving wheel 410, the second driving wheel 420 and the winding roller 430 are arranged on the mounting plate 401 in a line, and engaged in turns, that is, the first driving wheel 410 is engaged with the second driving wheel 420, and the second driving wheel 420 is then engaged with the winding roller 430. The first and the second guiding rollers 440 and 450 are rotationally mounted on two ends of the mounting plate 401, preferably are arranged in a line with the driving wheels 410, 420 and the winding roller 430. More specifically, the first guiding roller 440 fails to contact with the first driving wheel 420 and a gap is reserved, and the second guiding roller 450 fails to contact with the winding roller 430 and a gap is reserved.

Figure 5:
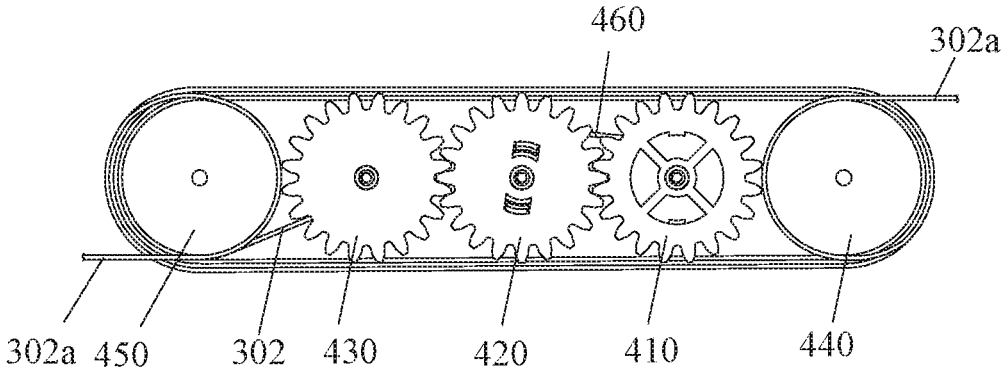
FIG. 5 is a schematic view of the driving assembly and the pull rope according to the first embodiment.

In other embodiments, the driving wheels 480, the winding roller 430 and the guiding rollers 440 and 450 can be ranged in nonlinearly, only if the driving wheels 480 are engaged with the winding roller 430 to actuate it, and the guiding rollers 440 and 450 are located at outer sides of the driving wheels 480 and the winding roller 430. It should be noted that, a linear arrangement for these elements is suitable for a narrow window blind to save arrangement room. As shown in FIG. 5, an elastic element 460 is configured between the first driving wheel 410 and the second driving wheel 420, specifically, one end of the elastic element 460 is connected to the first driving wheel 410, and another end of the elastic element 460 is connected to the second driving wheel 420. Preferably, the elastic element 460 is a coil spring. The elastic element 460 is wound around the first driving wheel 410 in an operation status, and is wound around the second driving wheel 420 while in another operation status. The first driving wheel 410, the second driving wheel 420 and the elastic member 460 supply a lift force to counteract the resultant force of the gravity of the slats and the force applied by a hand. Specifically, as shown in FIG. 4, the first driving wheel 410 has a top and a bottom engaging plate 411, and a receiver 412 for receiving the elastic member 460. Preferably, the first driving wheel 410 is in integrated structure and rotationally mounted on the mounting plate 401. The second driving wheel 420 has a top and a bottom engaging plate 421, a spindle 423 rotationally mounted on the mounting plate 401, and an elastic leaf wheel 422 rotationally mounted on the spindle 423. The elastic element 460 is received in the elastic leaf wheel 422, one end of the elastic element 460 is connected to the first driving wheel 410, and another end of the elastic element 460 is connected to the elastic leaf wheel 422. In this embodiment, the engagement manner applied is gear engagement.

Figure 6:
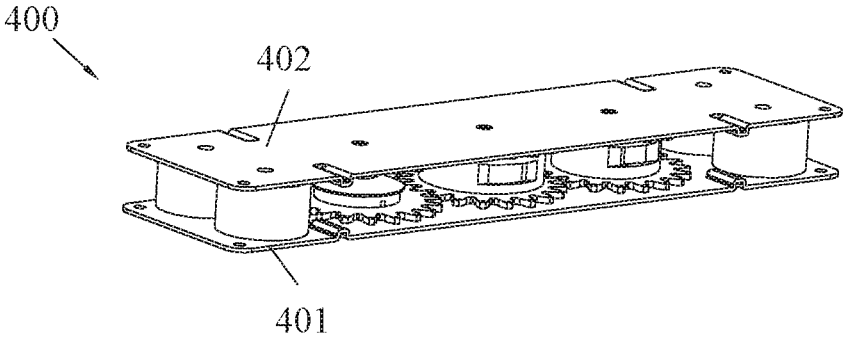
FIG. 6 is perspective view of a driving assembly according to a second embodiment.

The pull rope 302 has a starting end fixed to the winding roller 430. Under a status (the slats are folded), the pull rope 302 is wound around the outer edges of the second guiding roller 450 and the first guiding roller 440 in turns, and the terminating end of the pull rope 302 runs through the slats of the window blind and is connected to the bottom rail of the window blind. Under another status (the slats are opened), the pull rope 302 disengages from the winding roller 430, the second guiding roller 450 and the first guiding roller 440 in turns. As further explained, as illustrated in FIG. 6, after the partial pull rope 302 is wound on the winding roller 430, the pull rope 302 is wound along the outer edge of the second guiding roller 450, then wound along the outer edge of first guiding roller 440, then wound along the outer edge of the second guiding roller 450 again, repeatedly, the pull rope 302 is wound for circles. Specifically, the starting end of the pull rope 302 is a single pull rope section, and the pull rope 302 is divided into dual pull rope sections 302*a* at a predetermined position (such as the portion come out of the winding roller 430), and then one of dual pull rope section 302*a* will be come out of the first guiding roller 440, another of dual pull rope section 302*a* will be come out of the second guiding roller 450, so that two pull rope sections 302*a* are extended at two opposite directions, runs through two ends of the top rail 100 and the slats 300, and connected to two ends of the bottom rail 200. In such a way, the ends of the slats 300 and the bottom rail 200 can be actuated synchronously, thereby preventing asynchronization to generate inclination of the window blind when extending or retracting the window blind.

In other embodiments, the pull rope 302 can be divided into more than two pull rope sections at the predetermined position, which can be chosen according to the actual width of the window blind. Each pull rope section is connected to the slats and the bottom rail at different position, so that every position of the slats and the bottom rail can be actuated synchronously to achieve synchronous extending or synchronous retracting.

For keeping the pull rope 302 stable on the winding roller 430, a groove (not shown) can be configured on the winding roller 430.

Figure 7:
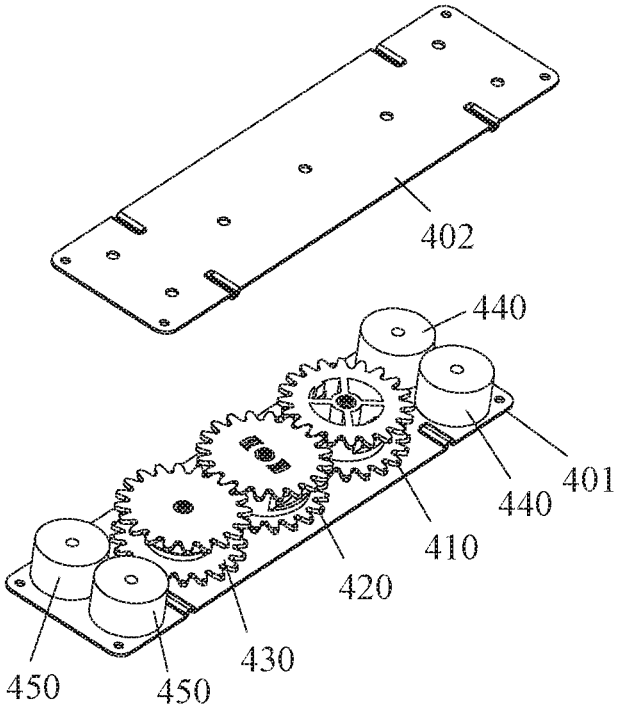
FIG. 7 is a partial exploded view of FIG. 6.
Figure 8:
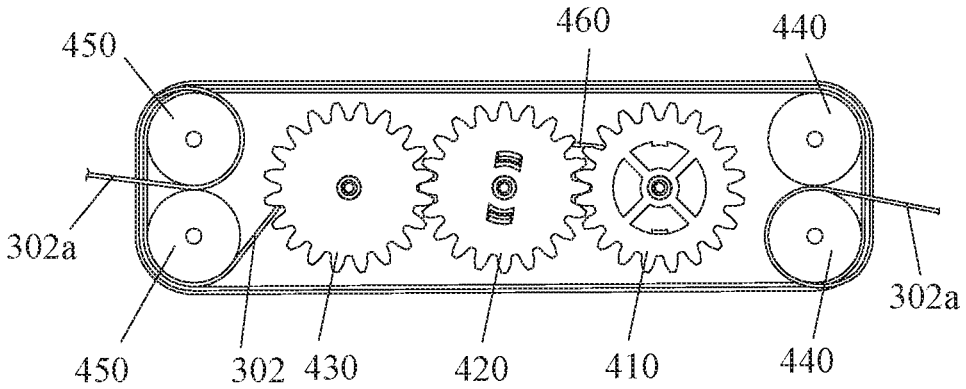
FIG. 8 is a schematic view of the driving assembly and the pull rope according to the second embodiment.

In another embodiment, the amount of the first guiding roller 440 and the second guiding roller 450 can be two, as shown in FIGS. 6-8, two first guiding rollers 440 at a side of the first driving wheel 410 are in parallel arrangement, two second guiding roller 450 at a side of the winding roller 430 are in parallel arrangement. Specifically, the two first guiding rollers 440 are linearly arranged along the width direction of the mounting plate 401, and a gap is kept therebetween; and the two second guiding rollers 450 are linearly arranged along the width direction of the mounting plate 401, and a gap is kept therebetween. The pull rope 302 is firstly come out of the winding roller 430, then winds along the edges of the two second guiding rollers 450, then winds along the edges of the two first guiding roller 440, and again winds along the edges of the two second guiding rollers 450, repeatedly, the pull rope 302 is wound for circles. Furthermore, the front section of the pull rope 302 is wound around the winding roller 430, and then the pull rope 302 come out of the winding roller 430 is divided into dual pull rope sections 302*a* which is wound along the edges of the second guiding rollers 450 and the edges of the first guiding rollers 440 in turns, after several circles, one section 302*a* will be come out of one of the second guiding rollers 450; another section 302*a* will sequentially wind along the edge of the second guiding roller 450 and then come out of one of the first guiding rollers 440. The two sections 302*a* are respectively connected with the slats 300 and the bottom rail 200.

Figure 9:
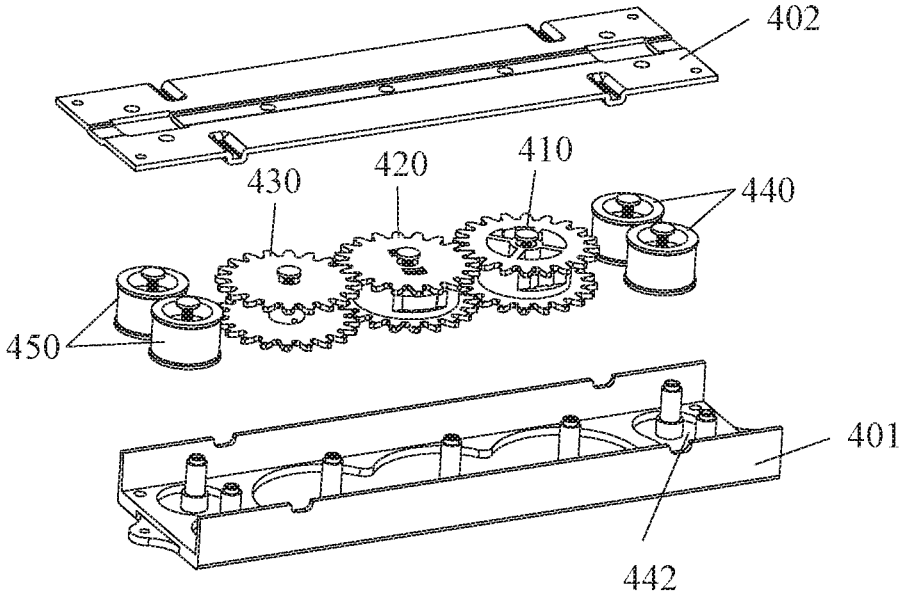
FIG. 9 is a partial exploded view of the driving assembly according to a third embodiment.
Figure 10:
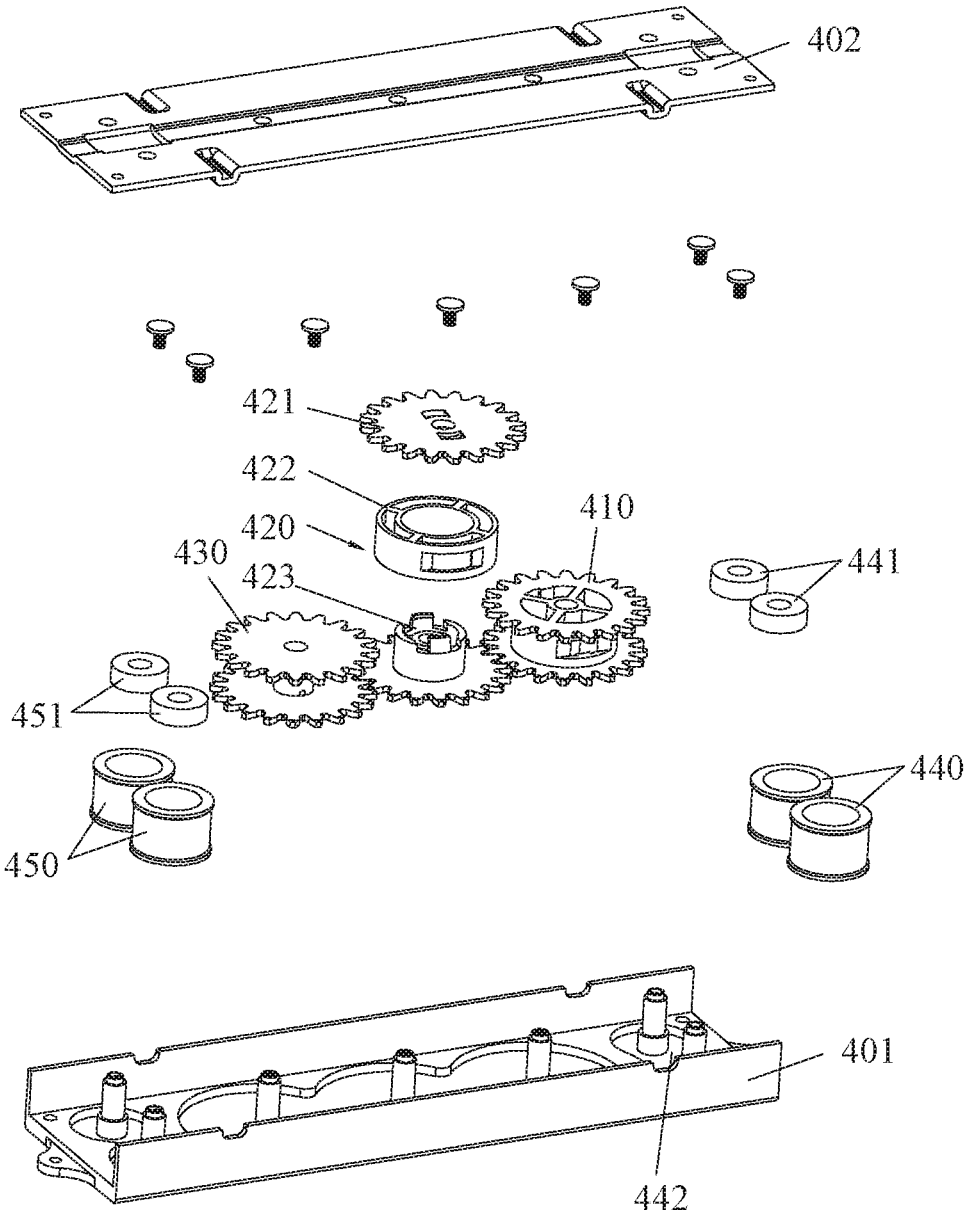
FIG. 10 is a further exploded view of FIG. 9.

Preferably, as shown in FIGS. 9-10, a bearing 441 is provided on the each guiding roller 440, 450, by means of which, the guiding rollers 440, 450 are rotationally mounted on the mounting plate 401. In such a way, the frictional resistance is further reduced to make the movement of the pull rope 302 smooth. More preferably, a recess 442 is formed on the mounting plate 401 respectively, corresponding to the positions of the guiding rollers 440 and 450, so that the rotation portions of the guiding rollers 440 and 450 are suspended from the mounting plate 401 to reduce the frictional resistance. Similarly, recesses also can be set corresponding to the positions of the driving wheels or winding roller.

Detailed structures of other components in the present embodiment are consistent with the first embodiment, thus which are omitted here.

Figure 11:
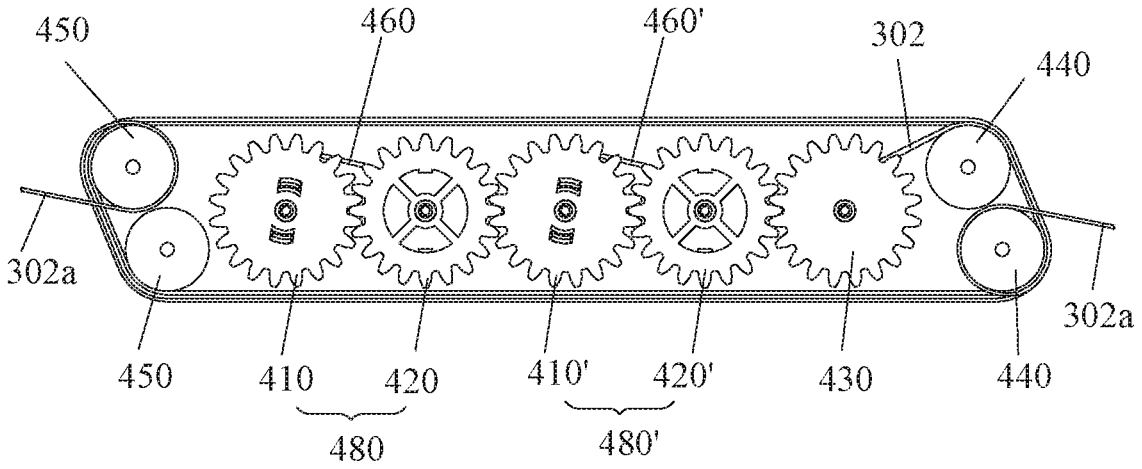
FIG. 11 is a schematic view of the driving assembly and the pull rope according to the third embodiment.

In other embodiments, the amount of the driving wheels can be two pairs or more, in order to provide sufficient elastic force for wider window blinds. For example, in the embodiment shown in FIG. 11, two pairs of driving wheels 480, 480' are provided, which includes a first driving wheel 410, a second driving wheel 420, a third driving wheel 410' and a fourth driving wheel 420' that are engaged one by one. Further, an elastic member 460 is configured between the first driving wheel 410 and the second driving wheel 420, and an elastic member 460' is configured between the third driving wheel 410' and the fourth driving wheel 420', while a winding roller 430 is located at the end and engaged with the fourth driving wheel 420'. Note, the arrangement of the guiding rollers 440, 450 is not limited by the above embodiments, for example, they can be arranged slantwise at the width direction of the mounting plate 401. While the winding manner of the pull rope 302 is the same with the second embodiment, which is not repeated here.

In conclusion, the driving assembly 400 of the present invention includes the driving wheels 480 and the winding roller 430 that are engaged with one another, the pull rope 302 is divided into two or more sections at the predetermined position, and the pull rope 302 is partially wound on the winding roller 430 and wound on the second guiding roller 450 and the first guiding roller 410 in turns along their edges, such a winding manner can achieve synchronous movements of two ends of the window blind, thereby preventing asynchronization to generate inclination of the window blind when extending or retracting the window blind. Furthermore, the structure is simple, and an effortless and quick operation to pull or lift the window blind is obtained. Additionally, the present invention has reduced cost and simple assembly to save time and manpower, the using life is extended, and the manufacturing method is easy, which is desired by the manufacturers.

It should be noted that, the front section of the pull rope 302 is wound on the same and single winding roller 430, and the followed sections 302*a* are wound on the two guiding rollers 440, 450 synchronously, thus the movements of the pull rope 302 at two sides are synchronous to achieve the synchronous extending and synchronous retracting.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. A driving assembly, adapted for window blinds, the driving assembly comprising a mounting plate, a winding roller and at least one pair of driving wheels that are engaged with one another and rotationally mounted on the mounting plate, at least one first guiding roller located at a side of the at least one pair of driving wheels, and at least one second guiding roller located at a side of the winding roller, wherein an elastic element is elastically wound around the driving wheels to provide driving force for the winding roller, a pull rope has a starting end fixed to the winding roller and wound around the winding roller for several circles, and the pull rope is divided into at least two pull rope sections including a first pull rope section and a second pull rope section after the starting end comes out of the winding roller, the pull rope sections are adapted for running through multiple slats of the window blinds and connected with a bottom rail of the window blinds, the first pull rope section and the second pull rope section are wound along outer edges of the second guiding roller and outer edges of the first guiding roller in turns for several circles, the first pull rope section comes out of the first guiding roller, and the second pull rope section comes out of the second guiding roller; under a first status, the pull rope partially winds around the winding roller then winds around the second guiding roller and the first guiding roller in turns along outer edges of the second guiding roller and the first guiding roller; while under a second status, the pull rope disengages from the winding roller, the second guiding roller and the first guiding roller in turns.

2. The driving assembly according to claim 1, wherein the driving wheels comprises a first driving wheel and a second driving wheel that are engaged with one another, and the second driving wheel is further engaged with the winding roller.

3. The driving assembly according to claim 2, wherein the elastic element is elastically wound between the first driving wheel and a second driving wheel, one end of the elastic element is connected to the first driving wheel, and another end of the elastic element is connected to the second driving wheel.

4. The driving assembly according to claim 2, wherein the second driving wheel comprises an engaging plate that is engaged with the first driving wheel and the winding roller, a spindle rotationally mounted on the mounting plate, and an elastic leaf wheel rotationally mounted on the spindle, the elastic element is received in the elastic leaf wheel, one end of the elastic element is connected to the first driving wheel, and another end of the elastic element is connected to the elastic leaf wheel.

5. The driving assembly according to claim 1, wherein two pairs of driving wheels are included, each pair of driving wheels has two driving wheels engaged with one another, and one said elastic element is configured between the two driving wheels.

6. The driving assembly according to claim 1, wherein the first driving wheel comprises an engaging plate that is engaged with the second driving wheel and a spindle rotationally mounted on the mounting plate.

7. The driving assembly according to claim 1, wherein the first guiding roller and the second guiding roller are rotationally mounted on the mounting plate.

8. The driving assembly according to claim 1, wherein a bearing is respectively provided on the first guiding roller and the second guiding roller.

9. The driving assembly according to claim 1, wherein two first guiding rollers and two second guiding rollers are included.

10. The driving assembly according to claim 1, wherein a groove is formed on the first guiding roller and/or the second guiding roller for guiding the pull rope.

11. The driving assembly according to claim 1, wherein two first guiding rollers and two second guiding rollers are included, the first pull rope section and the second pull rope section are wound along outer edges of the second guiding rollers and outer edges of the first guiding rollers in turns for several circles, the first pull rope section comes out of one of the first guiding rollers, and the second pull rope section comes out of one of the second guiding rollers.

12. A window blind, comprising a top rail, a bottom rail and multiple slats that are movable relative to the top rail, and a driving assembly mounted in the top rail to actuate the slats and the bottom rail, wherein the driving assembly is according to claim 1.

13. The window blind according to claim 12, wherein the driving wheels comprises a first driving wheel and a second driving wheel that are engaged with one another, and the second driving wheel is further engaged with the winding roller.

14. The window blind according to claim 13, wherein the elastic element is elastically wound between the first driving wheel and a second driving wheel, one end of the elastic element is connected to the first driving wheel, and another end of the elastic element is connected to the second driving wheel.

15. The window blind according to claim 13, wherein the second driving wheel comprises an engaging plate that is engaged with the first driving wheel and the winding roller, a spindle rotationally mounted on the mounting plate, and an elastic leaf wheel rotationally mounted on the spindle, the elastic element is received in the elastic leaf wheel, one end of the elastic element is connected to the first driving wheel, and another end of the elastic element is connected to the elastic leaf wheel.

16. The window blind according to claim 12, wherein two pairs of driving wheels are included, each pair of driving wheels has two driving wheels engaged with one another, and one said elastic element is configured between the two driving wheels.

17. The window blind according to claim 12, wherein the first guiding roller and the second guiding roller are rotationally mounted on the mounting plate.

18. The window blind according to claim 12, wherein a bearing is respectively provided on the first guiding roller and the second guiding roller.

19. The window blind according to claim 12, wherein a groove is formed on the first guiding roller and/or the second guiding roller for guiding the pull rope.

20. The window blind according to claim 12, wherein two first guiding rollers and two second guiding rollers are included, the first pull rope section and the second pull rope section are wound along outer edges of the second guiding rollers and outer edges of the first guiding rollers in turns for several circles, the first pull rope section comes out of one of the first guiding rollers, and the second pull rope section comes out of one of the second guiding rollers.

* * * * *